US011764023B2

(12) United States Patent
O'Neil et al.

(10) Patent No.: US 11,764,023 B2
(45) Date of Patent: Sep. 19, 2023

(54) SYSTEMS AND METHODS FOR PROVIDING FLUID-AFFECTED FUSES

(71) Applicant: Rivian IP Holdings, LLC, Plymouth, MI (US)

(72) Inventors: Kyle O'Neil, Los Angeles, MI (US); Travis Cournoyer, Redondo Beach, CA (US)

(73) Assignee: Rivian IP Holdings, LLC, Plymouth, MI (US)

( * ) Notice: Subject to any disclaimer, the term of this patent is extended or adjusted under 35 U.S.C. 154(b) by 133 days.

(21) Appl. No.: 17/080,179

(22) Filed: Oct. 26, 2020

(65) Prior Publication Data

US 2022/0130631 A1 Apr. 28, 2022

(51) Int. Cl.
*H01H 85/165* (2006.01)
*H01H 85/143* (2006.01)

(52) U.S. Cl.
CPC ..... *H01H 85/165* (2013.01); *H01H 85/143* (2013.01)

(58) Field of Classification Search
CPC ..... H01H 85/143; H01H 85/47; H01H 85/165–1755
See application file for complete search history.

(56) References Cited

U.S. PATENT DOCUMENTS 4,041,434 A * 8/1977 Jacobs, Jr. ..... H01H 85/47 337/204
4,375,630 A * 3/1983 Gaia ..... H01H 85/47 337/248
5,581,192 A 12/1996 Shea et al.
9,035,739 B2 5/2015 Boe et al.
2003/0085048 A1* 5/2003 Lindholm ..... H01H 85/47 174/17 VA
2013/0293341 A1* 11/2013 Krause ..... H01H 85/0241 337/187
2015/0054614 A1* 2/2015 Blewitt ..... H01H 85/40 337/292
2015/0371803 A1* 12/2015 Hosomizo ..... H01H 85/12 337/142
2017/0244141 A1* 8/2017 Weicker ..... H01M 10/613
2017/0365433 A1* 12/2017 Hadler-Jacobsen ..... H01H 85/0241
2018/0217646 A1* 8/2018 Mikkelsen ..... G06F 1/206
2019/0296658 A1* 9/2019 Chung ..... H02M 7/003

OTHER PUBLICATIONS

Transformers and Oils (Year: 2018).*

* cited by examiner

*Primary Examiner* — Jacob R Crum
(74) *Attorney, Agent, or Firm* — Haley Guiliano LLP

(57) ABSTRACT

A fluid-affected fuse includes a structural housing, a pair of electric terminals, one or more fuse elements, and a fluid arranged in an internal volume of the structure. The structure provides rigidity to the fuse. The terminals are coupled to the structural housing and are configured to be coupled to an electric power circuit of a battery circuit. The one or more fuse elements are electrically connected in series to the pair of electric terminals and are arranged in the internal volume. The fluid is configured to affect a temperature of the fuse element. A fluid-filled fuse is filled with fluid, optionally sealed, and operated with the increased heat capacity of the fluid to affect temperature of the fuse. A fluid-cooled fuse is filled with the fluid, undergoing a stream of the fluid thus allowing control of fuse temperature. A control system controls the fluid stream and fuse operation.

20 Claims, 4 Drawing Sheets

SYSTEMS AND METHODS FOR PROVIDING FLUID-AFFECTED FUSES

INTRODUCTION

The present disclosure is directed to fluid-affected fuses, and more particularly to systems for controlling fuse operation based on fluid.

SUMMARY

In some embodiments, the present disclosure is directed to an apparatus including a structural housing, a pair of electrical terminals, a fuse element, and a fluid. The structural housing includes an internal volume. The electric terminals are coupled to the structural housing and are configured to be coupled to an electric power circuit of a battery circuit. The fuse element is electrically connected in series to the electric terminals and is arranged at least partially in the internal volume. The fluid is configured to affect a temperature of the fuse element. The apparatus is also referred to as a fluid-affected fuse.

In some embodiments, the apparatus includes a port arranged in the structural housing and is configured to allow the fluid to be provided to the internal volume.

In some embodiments, the apparatus includes a first port arranged in the structural housing that is configured to allow the fluid to be provided to the internal volume, and a second port arranged in the structural housing that is configured to allow the fluid to be removed from the internal volume. For example, in some embodiments, the first port and the second port are configured to provide an inlet and an outlet to the internal volume.

In some embodiments, the apparatus includes a sensor configured to sense at least one characteristic of the apparatus. In some such embodiments, the sensor is arranged in the structural housing. In some embodiments, the at least one characteristic includes a temperature of the apparatus and the sensor is configured to sense the temperature. For example, the temperature is a temperature of the fluid, a temperature of the structural housing, a temperature of a fluid stream, a temperature of an electrical terminal or busbar, or a temperature of another component indicative of the fuse.

In some embodiments, the fluid includes at least one of water, oil, ethylene glycol, or a combination thereof. For example, in some embodiments, the fluid includes K-class transformer oil, mineral oil, oil containing synthetic esters, oil containing natural esters, or coolant.

In some embodiments, the present disclosure is directed to a system that includes an electric power system, a fuse, and control circuitry. The electric power system includes at least one busbar. The fuse is configured to provide circuit protection and includes a pair of terminals, a structural housing, a fuse element, and a fluid. The pair of terminals is electrically coupled to the at least one busbar. The structural housing includes an internal volume. The fuse element is electrically coupled between the pair of terminals and is arranged in the internal volume. The fuse element is configured to uncouple the terminals at a predetermined condition. The fluid is arranged in the internal volume, around or otherwise proximal to the fuse element. The control circuitry is configured to monitor at least one characteristic of the fuse during operation.

In some embodiments, the system includes a sensor configured to sense the at least one characteristic of the fuse. The sensor is communicatively coupled to the control circuitry. In some embodiments, the at least one characteristic includes a temperature of the fluid arranged in the internal volume.

In some embodiments, the system includes a fluid management system configured to circulate a fluid stream through the internal volume of the structural housing. The fluid in the internal volume is supplied by the fluid stream. For example, in some embodiments, the fuse includes a first port and a second port arranged in the structural housing, and the fluid stream enters the internal volume via the first port and leaves the internal volume via the second port.

In some embodiments, the fluid management system includes a pump, fluid conduits, and fittings configured to manage the fluid stream. In some embodiments, the control circuitry is coupled to the fluid management system and is further configured to provide a control signal to the fluid management system to control the fluid stream. In some embodiments, the control circuitry is further configured to provide the control signal to the fluid management system to control a temperature of the fuse.

In some embodiments, the present disclosure is directed to a method for managing a fluid-affected fuse. The method includes monitoring one or more sensor signals indicative of fuse operation, applying current to one or more busbars of a battery system, and generating a control signal for controlling a fluid stream configured to flow through an internal volume of the fuse. A fuse is electrically coupled to the one or more busbars such that the current flows through the fuse.

In some embodiments, monitoring the one or more sensor signals includes monitoring a temperature sensor signal of a temperature sensor configured to sense a temperature of the fluid stream. In some such embodiments, generating the control signal includes generating the control signal to control a temperature of the fuse.

In some embodiments, the method includes determining a fault has occurred based on the one or more sensor signals.

BRIEF DESCRIPTION OF THE DRAWINGS

The present disclosure, in accordance with one or more various embodiments, is described in detail with reference to the following figures. The drawings are provided for purposes of illustration only and merely depict typical or example embodiments. These drawings are provided to facilitate an understanding of the concepts disclosed herein and shall not be considered limiting of the breadth, scope, or applicability of these concepts. It should be noted that for clarity and ease of illustration these drawings are not necessarily made to scale.

DETAILED DESCRIPTION

The present disclosure is directed to fuses having properties that are based on a fluid. In some embodiments, a fuse is filled with fluid and then sealed. In some embodiments, a fuse is fluid-cooled (e.g., based on a flow rate of the fluid). To illustrate, fluid-filled and fluid-cooled fuses may be implemented with or without electrically conductive fluid. Because the fuse elements (e.g., carrying electrical current) may operate at high voltage, an electrical insulator may be used to prevent the fluid from being energized. The use of fluid-filled or fluid-cooled fuses may allow a more compact design (e.g., which in turn can increase energy density of an associated battery pack), support of high performance targets (e.g., high currents) while maintaining system durability, or both.

Figure 1:
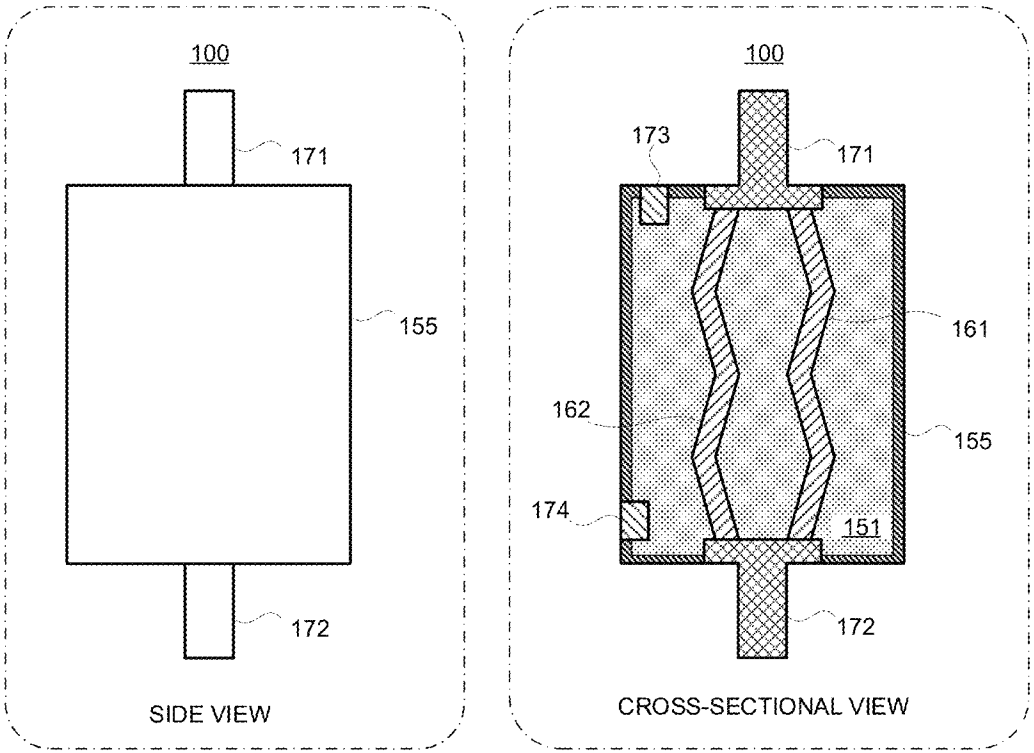
FIG. 1 shows a side view and cross-sectional side view of an illustrative fluid-filled fuse, in accordance with some embodiments of the present disclosure.

FIG. 1 shows a side view and cross-sectional side view of illustrative fluid-filled fuse 100, in accordance with some embodiments of the present disclosure. As illustrated, fuse 100 includes structure 155, terminals 171 and 172, port 173, sensor 174, elements 161 and 162, and fluid 151. Structure 155, as illustrated, includes a sidewall and end portions, which serve as the packaging of fuse 100. For example, structure 155 may provide electrical insulation, structure rigidity, access for fluid 151, containment for fluid 151, protection of elements 161 and 162, any other suitable functionality, or any combination thereof. Terminals 171 and 172 are configured to be electrically coupled to an electric circuit. In some embodiments, terminals 171 and 172 are electrically insulated from structure 155, such that all current flow between terminals 171 and 172 passes through and along elements 161 and 162. For example, fuse 100 may be included in-line (in series with) a busbar such that the electric current flowing through the busbar traverses fuse 100 (e.g., between terminals 171 and 172). To illustrate, elements 161 and 162, which are arranged electrically in parallel, may conduct electrical current between terminals 171 and 172. In some embodiments, elements 161 and 162 may be similar (e.g., and included in integer multiples in accordance with the current rating of fuse 100). In some embodiments, a single element is included in a fluid-filled fuse, wherein the element is sized for a predetermined current capacity.

Fluid 151 is arranged and contained in an interior cavity of structure 155. To illustrate, an interior space of structure 155 may be filled, via port 173, with fluid 151. After filling, port 173 may be closed or otherwise sealed to prevent leakage or spillage. In some embodiments, port 173 may function as a vent. In some embodiments, fluid 151 may include a sufficient thermal conductivity to transfer heat from elements 161 and 162 that may be generated from Ohmic losses (e.g., based on electronic resistivity). In some embodiments, fluid 151 may be non-electronically conductive (e.g., oil, non-polar liquids, non-ionized liquids). In some embodiments, structure 155, elements 161 and 162, terminals 171 and 172, or a combination thereof, may include a dielectric coating, layer, or insert that may electrically insulate fluid 151 from solid state components (e.g., terminals, elements, structures). In some embodiments, port 173 may be opened or otherwise accessible to inspect, sample, or otherwise characterize fluid 151, elements 161 and 162, or a combination thereof. For example, port 173 may include a removable plug, which may be removed to inspect, characterize, and/or service fluid 151 (e.g., inspect color measure viscosity, analyze composition, refill fluid 151, drain fluid 151).

To illustrate, the additional thermal mass of fluid 151 (e.g., as defined by the heat capacity of fluid 151) relative to that of the rest of fuse 100 may help temperature control of fuse 100. For example, the thermal mass of fluid 151 may mitigate temperature rise of elements 161 and 162 by increasing the effective heat capacity of the fuse. In a further example, fuse 100 may cause elements 161 and 162 to exhibit a relatively smaller temperature rise than if fluid 151 were not present. In some embodiments, the increased thermal mass provided by fluid 151 may reduce the severity of thermal shocks (e.g., amplitude of temperature changes). In some embodiments, the presence of fluid 151 may affect the time-response of fuse 100. For example, the presence of fluid 151 may act as a filter against peaks in current over suitable time scales (e.g., by preventing temperature rise).

As illustrated, fuse 100 includes sensor 174. Sensor 174 is configured to sense one or more properties, or changes thereof, of fuse 100. For example, in some embodiments, sensor 174 includes a temperature sensor (e.g., a thermocouple, a thermopile, a thermistor, a resistive temperature detector (RTD), any other suitable temperature sensor, or any combination thereof for sensing the temperature of fluid 151, structure 155, or both. In a further example, sensor 174 may include a pressure sensor, a voltage sensor, a sensor configured to detect a property of fluid 151 (e.g., optical, thermophysical, electrical, chemical, or electrochemical property), any other suitable type of sensor, or any combination thereof. In some embodiments, sensor 174 may be coupled to a control system or sensor interface thereof, and a signal from sensor 174 may be used as an indicator to monitor a state of fuse 100 or elements 161 and 162 thereof. In some embodiments, based on characteristics of fluid 151, an overall package size of the fuse may be reduced by inclusion of fluid 151. In some embodiments, sensor 174 is installed in port 173 (e.g., after filling with fluid 151). For example, sensor 174 may be removably, or permanently installed in port 173.

Fluid 151 may have any suitable properties such as for example, viscosity, density, conductivity (e.g., electrical and/or thermal), flash point, boiling point, freezing point, heat capacity, corrosion resistance, any other suitable property, or any combination thereof. For example, the freezing temperature of fluid 151 may be selected to prevent a phase change of fluid 151 (e.g., particularly for fluid-filled fuses wherein the fluid is not circulated). In a further example, fluid 151 may be sufficiently electrically insulative to prevent electrical shorting within fuse 100 (e.g., without the need for dielectric inserts to isolate elements 161 and 162 from structure 155). Fluid 151 may include, for example, water (W), ethylene glycol (EG), WEG mixtures, low-viscosity oil (e.g., silicone oil, mineral oil, synthetic oil, synthetic esters, natural esters), high-viscosity K-class oil (e.g., silicone oil, mineral oil, synthetic oil, synthetic esters, natural esters), phase-change fluorinated synthetic fluids (e.g., Novec), any other suitable fluid, any suitable additives (e.g., a corrosion inhibitor), or any suitable combination thereof.

Figure 2:
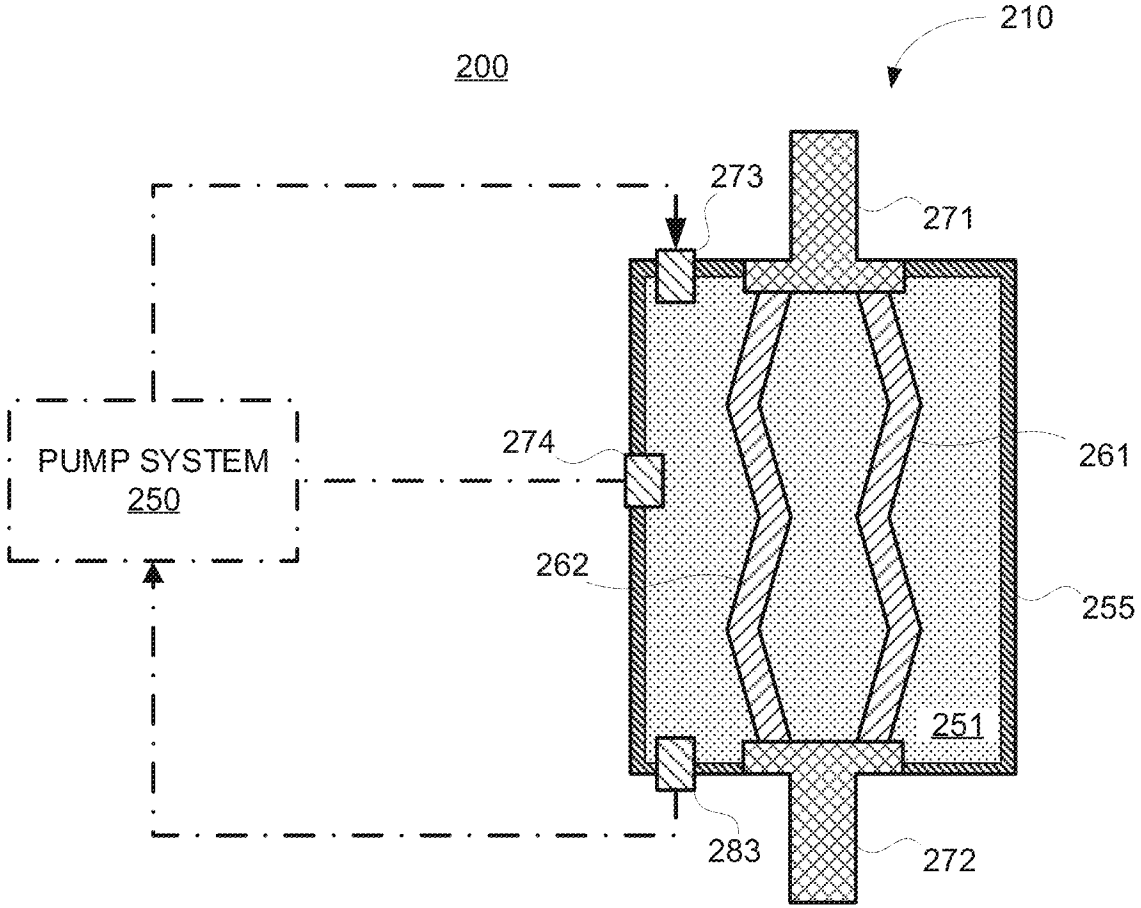
FIG. 2 shows a cross-sectional side view of an illustrative fluid-cooled fuse and a pump system, in accordance with some embodiments of the present disclosure.

FIG. 2 shows a cross-sectional side view of illustrative fluid-cooled fuse 210 and pump system 250, in accordance with some embodiments of the present disclosure. System 200, as illustrated, includes fluid-cooled fuse 210, pump system 250, any suitable fluid conduits for providing and returning fluid (e.g., fluid 251), any suitable sensor interface (e.g., for interfacing to sensor 274), any other suitable components (not illustrated), or any combination thereof. In some embodiments, fuse 210 may be similar to fuse 100, other than more than one port may be included. For example, fuse 210 may be included in-line (in series with) a busbar such that the electric current flowing through the busbar traverses fuse 210 (e.g., between terminals 271 and 272). To illustrate, elements 261 and 262, which are arranged electrically in parallel, may conduct electrical current between terminals 271 and 272. In some embodiments, elements 261 and 262 may be similar (e.g., and included in integer multiples in accordance with the current rating of fuse 210). In some embodiments, a single element is included in a fluid-cooled fuse, wherein the element is sized for a predetermined current capacity. Although illustrated as having two elements, a fluid-filled or fluid-cooled fuse may include any suitable number of elements (e.g., one, two, or more than two), in accordance with the present disclosure.

As illustrated, fuse 210 includes structure 255, terminals 271 and 272, ports 273 and 283, sensor 274, elements 261 and 262, and fluid 251 (e.g., included in an internal volume of structure 255). Ports 273 and 283 are configured to allow fluid to flow into and out of the internal volume of structure 255. For example, pump system 250 is configured to pump fluid 251 to and from fuse 210 via suitable conduits such as tubes, pipes, hoses, fittings, plenums, manifolds, or combination thereof. Pump system 250 may include, for example, a centrifugal pump, a positive displacement pump (e.g., a piston pump), a vacuum system, a bladder system, any other suitable system for moving fluid, or any combination thereof. In some embodiments, pump system 250 includes control circuitry having a sensor interface configured to receive a sensor signal from sensor 274. To illustrate, sensor 274 may be similar to sensor 174 of FIG. 1. To illustrate further, sensor 274 may include a sensor configured to sense temperature (e.g., of fluid 251 or any other suitable part of fuse 210), pressure (e.g., of fluid 251 in the internal volume of structure 255), pressure drop (e.g., across ports 273 and 283 or any other suitable pressure difference), any other suitable property, or any combination thereof. In some embodiments, sensor 274 may be integrated into one or both of ports 273 and 283. In some embodiments, sensor 274 may be arranged in a fluid conduit rather than integrated or inserted in structure 255.

Fluid 251 may have any suitable properties such as for example, viscosity, density, conductivity (e.g., electrical and/or thermal), flash point, boiling point, heat capacity, any other suitable property, or any combination thereof. Fluid 251 may include, for example, water (W), ethylene glycol (EG), WEG mixtures, low-viscosity oil (e.g., silicone oil, mineral oil, synthetic oil, synthetic esters, natural esters), high-viscosity K-class oil (e.g., silicone oil, mineral oil, synthetic oil, synthetic esters, natural esters), phase-change fluorinated synthetic fluids (e.g., Novec), any other suitable fluid, or any combination thereof.

Figure 3:
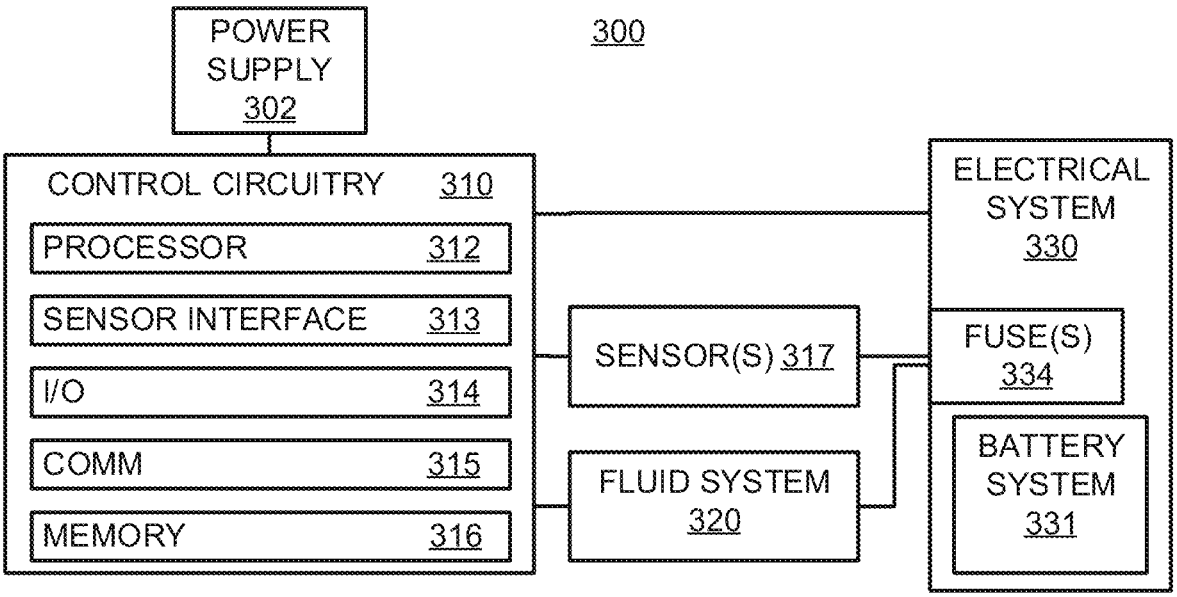
FIG. 3 shows a block diagram of an illustrative system for managing fuses, in accordance with some embodiments of the present disclosure.

FIG. 3 shows a block diagram of illustrative system 300 for managing fuses 334, in accordance with some embodiments of the present disclosure. As illustrated, system 300 includes power supply 302, control circuitry 310, fluid system 320, and electrical system 330. Electrical system 330, as illustrated, includes battery system 331, wherein fuse(s) 334 may be electrically coupled to busbars of battery system 331. Fluid system 320, as illustrated, may optionally be included to manage a fluid flow to and from fuse(s) 334. For example, in some embodiments, wherein fuse(s) 334 include fluid-filled fuses, fluid system 320 need not be included (e.g., or may be included to fill the fluid-filled fuses but not used during operation). To illustrate, system 300 may be part of an electric vehicle, wherein battery system 331 is configured to provide power to a powertrain of the electric vehicle. To further illustrate, any or all of fuse(s) 334 may include a fuse similar to fuse 100 of FIG. 1 or fuse 210 of FIG. 2.

As illustrated, control circuitry 310 includes processor 312, sensor interface 313, input/output 314 (hereinafter referred to as I/O 314), communication hardware 315 (hereinafter referred to as COMM 315), and memory 316. Control circuitry 310 may include hardware, software, or both, implemented on one or more modules configured to provide control, monitoring, or both of one or more fuses 334. In some embodiments, processor 312 includes one or more microprocessors, microcontrollers, digital signal processors, programmable logic devices, field-programmable gate arrays (FPGAs), application-specific integrated circuits (ASICs), or any suitable combination thereof. In some embodiments, processor 312 is distributed across more than one processor or processing units. In some embodiments, control circuitry 310 executes instructions stored in memory 316 for managing one or more of fuse(s) 334. In some embodiments, memory 316 is an electronic storage device that is part of control circuitry 310. For example, memory 316 may be configured to store electronic data, computer instructions, applications, firmware, or any other suitable information. In some embodiments, memory 316 includes random-access memory, read-only memory, hard drives, optical drives, solid state devices, or any other suitable memory storage devices, or any combination thereof. For example, memory may be used to launch a start-up routine.

In some embodiments, control circuitry 310 is powered by power supply 302. In some embodiments, power supply 302 includes a car battery (e.g., a 12 V lead acid battery), a DC-DC converter, an AC power supply (e.g., generated by suitably inverting a DC power supply), any other power supply, any corresponding components (e.g., terminals, switches, fuses, and cables), or any combination thereof. In some embodiments, power supply 302 supplies power to sensor(s) 317, fluid system 320, electrical system 330, any other suitable systems or components, or any combination thereof. In some embodiments, control circuitry 310, fluid system 320, or both may be powered by battery system 331.

Sensor interface 313 is configured to provide power or otherwise excitation to sensor(s) 317, receive sensor signals from sensor(s) 317, condition a sensor signal (e.g., filter, amplify, saturate, convert, or perform other conditioning), modulate a sensor signal, digitize a sensor signal (e.g., an analog-to-digital converter), or a combination thereof. In some embodiments, sensor interface 313 is configured to sample and digitize a sensor signal from sensor(s) 317. In some embodiments, sensor(s) 317 include one or more temperature sensors (e.g., a thermistor, a thermocouple, a thermopile, a resistance temperature detector, and infrared optical detector), pressure sensors (e.g., a strain-based or piezoelectric transducer), current sensors (e.g., a current loop or other transformer, a precision resistor), voltage sensors, optical sensors (e.g., for photonic properties or clarity), any other suitable sensors, or any combination thereof. For example, sensor(s) 317 may include a current sensor or voltage sensor configured to sense operation of fuse(s) 334 to determine operation of fuse(s) 334. Sensor(s) 317 may be integrated as part of fuse(s) 334, arranged proximal to fuse(s) 334, arranged in a conduit of fluid system 320, in any other suitable arrangement, or any combination thereof. In some embodiments, control circuitry 310 may determine a property value (e.g., a temperature value), whether fluid leaks are present, a flow rate, a pressure, any other suitable property, or any combination thereof based on one or more sensor signals.

I/O 314 and Comm 315 are configured to send and receive signals. In some embodiments, I/O 314 is configured to receive sensor signals (e.g., sensor interface 313 may integrated as part of I/O 314), send and receive digital signals, generate or measure current (e.g., 4-20 mA signals), generate or measure voltage (e.g., provide or measure analog voltage), provide binary signals (e.g., to control relays, switches, contactors, or transistors), provide electrical power (e.g., a DC bus for control signals), send or receive any other suitable signals, or any combination thereof. In some embodiments, Comm 315 includes a wireless communications interface (e.g., WiFi, Bluetooth, NFC, 4-G), wired interface (e.g., ethernet with RJ-45 connectors), optical interface (e.g., a fiber optic interface), any other suitable interface, or any combination thereof for communicating with other systems or devices.

Fluid system 320 is configured to manage a state of a fluid in a fluid-filled fuse, fluid-cooled fuse, or both, of fuse(s) 334. Fluid system 320 may include a pump (e.g., piston pump, centrifugal pump, vane pump, any other suitable pump, motors, motor drives, controllers), fluid conditioning system (e.g., pressure regulators, valving, throttles, degassing systems, tanks, manifolds, fittings), communications interface (e.g., for communicating with control circuitry 310), any other suitable components or systems, or any combination thereof. Fluid system 320 may be configured to fill fuse(s) 334 with fluid, provide a flow of fluid to fuse(s) 334, control a flow of fluid to fuse(s) 334, monitor a flow of fluid to fuse(s) 334, or a combination thereof. In some embodiments, fluid system 320 is used to fill a fuse, and then decoupled from system 300 during operation.

To illustrate, system 300 may allow the capability to vary the rate of flow of a fluid (e.g., via fluid system 320) to a fuse (e.g., one or more of fuse(s) 334) to match an electrical power demand of electrical system 330. For example, control circuitry 310 may be configured to receive a sensor signal from sensor 317 indicative of a current flowing through fuse(s) 334. Accordingly, the fluid flow may be increased to remove more heat away from fuse(s) 334 (e.g., or decrease fluid flow to lessen heat removal). In some embodiments, one or more valves are used at the inlet, outlet, or both of fuse(s) 334. For example, in some such embodiments, any or all of fuse(s) 334 may be drained of the fluid to affect when the fuse fails (e.g., when the fuse blows under a current load). To illustrate, in the event that a short circuit is detected, system 300 may cause the cooling load to fuse(s) 334 to be reduced, thus cause the fuse to fail rather than the short continue (e.g., which may cause damage to other components).

Electrical system 330, as illustrated, includes battery system 331 that includes a plurality of battery cells coupled together by one or more busbars. Fuse(s) 334 are arranged in-line (e.g., in series with) the one or more busbars and are configured to provide circuit protection against large currents (e.g., from shorting or high loads that may cause over-heating and failures). In some embodiments, electrical system 330 includes power electronics, electric motors, motor drives, any other suitable components, or any combination thereof that may transact electric power with battery system 331. For example, control circuitry 310 may generate control signals and transmit the control signals via I/O 314 to electrical system 330 to control one or more motor drives or IGBTS that control power to one or more electric motors (e.g., of an electric vehicle powertrain).

Figure 4:
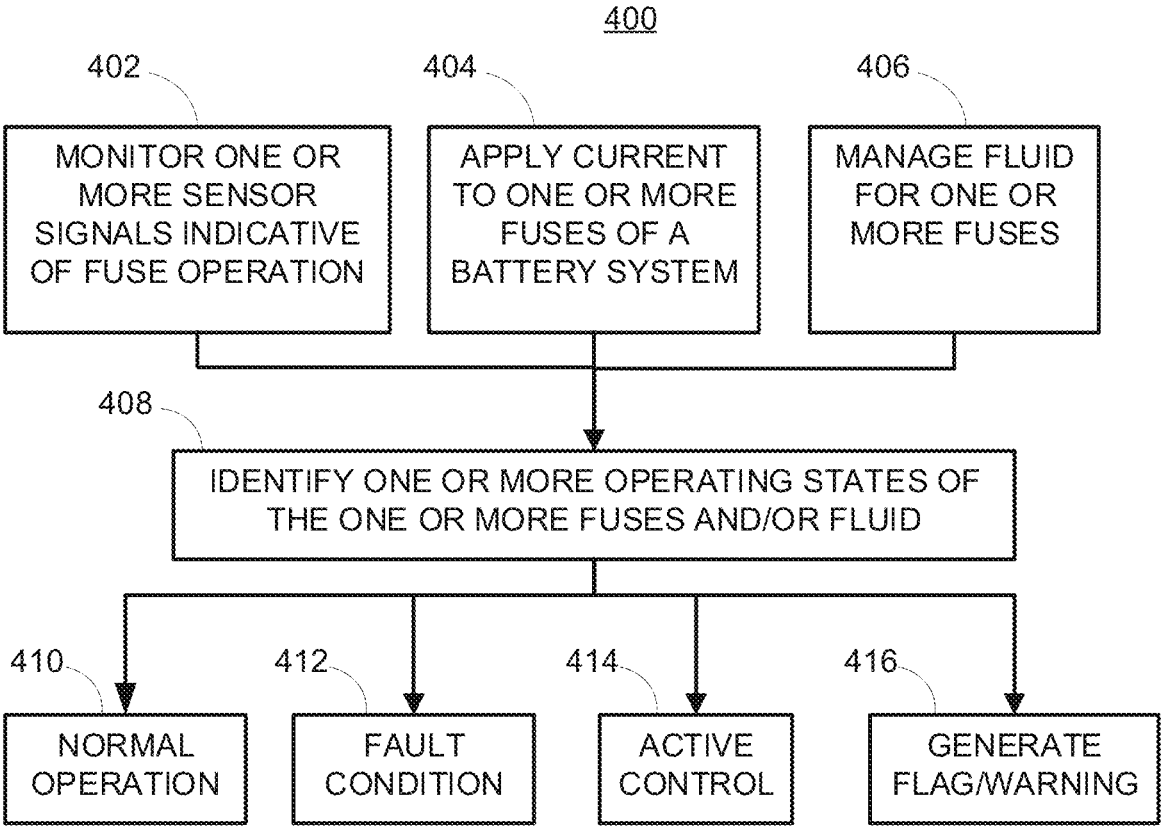
FIG. 4 shows a flowchart for an illustrative process for managing a fluid-affected fuse, in accordance with some embodiments of the present disclosure.

FIG. 4 shows a flowchart for illustrative process 400 for managing a fluid-affected fuse, in accordance with some embodiments of the present disclosure. In an illustrative example, process 400 may be implemented by system 300 of FIG. 3, or any portion thereof.

Step 402 includes the system monitoring one or more sensor signals indicative of fuse operation. In some embodiments, the system monitors one or more sensors integrated into one or more fuses, one or more sensors installed in a fluid conduit coupled to one or more fuses, or a combination thereof. The system may monitor the one or more sensor signals, for example, continuously, at a predetermined frequency, in response to a query or event (e.g., in response to a message from a controller, a value of a property, a state of the system), at a predetermined time, or any combination thereof. In some embodiments, the system determines a metric (e.g., a load rating, a health indicator), property value (e.g., a temperature, a voltage, a current, a pressure), any other suitable value, or any combination thereof to monitor fuse operation or fuse state. In some embodiments, the system stores (e.g., in memory), filters (e.g., averages, low-pass filters, high-pass filters, notch filters, bandpass filters, or a combination thereof), recalls (e.g., from memory), or otherwise manages values or metrics of one or more sensor signals. In some embodiments, a sensor signal is used to determine or estimate a property value (e.g., the sensor signal may serve as proxy). For example, fluid temperatures may be used to determine or estimate a temperature of a fuse element (e.g., using any suitable functional mapping, model, or algorithm).

Step 404 includes the system applying current to one or more fuses of a battery system. In some embodiments, the system manages electric power distribution from a power source (e.g., battery system 331 of FIG. 3) to one or more loads. The electric power may traverse the one or more fuses. For example, the one or more fuses may be arranged in series with one or more busbars (e.g., that define a DC bus of battery system 331) and may be configured to blow (e.g., fail) at a predetermined current under predetermined conditions (e.g., to any suitable precision or repeatability). The system may provide control signals to a power electronics system to control current flow in the one or more busbars and thus in the one or more fuses. The system may apply current in response to a load, for example.

Step 406 includes the system managing fluid for one or more fuses. In some embodiments, the system includes components for controlling a fluid stream in the one or more fuses (e.g., any or all of fluid system 320 of FIG. 3). In some embodiments, the system controls a flow rate (e.g., by controlling a pump, a valve, a pressure, or other aspect of the fluid), a temperature of the fluid, a pressure of the fluid, a temperature of a fuse element or fuse body (e.g., the structural support), any other suitable characteristic of fuse operation, or any combination thereof. In some embodiments, process 400 need not include step 406. For example, the system may include fluid-filled fuses, which, in some embodiments, do not require management during operation.

Step 408 includes the system identifying one or more operating states of the one or more fuses, the fluid, or both. In some embodiments, the system is configured to take as input one or more sensor signals, one or more metrics determined based on one or more sensor signals, any other suitable information, or any combination thereof to determine the operating state. Any suitable operating state may be identified including, for example, normal operation (e.g., state 410), a fault condition (e.g., state 412), active control (e.g., state 414), generate a flag or warning (e.g., state 416), any other suitable state or mode, or any combination thereof.

In some embodiments, the system may retrieve information from memory, a database, or other suitable reference while monitoring the one or more sensor signals, applying current to the one or more fuses, managing the fluid for the one or more fuses, or a combination thereof. For example, refencing a fluid-filled fuse, the system may, but need not actively control operation but rather may monitor one or more sensor signals (or metrics derived thereof) to compare with a reference database. The reference database may include prescribed ranges, property values, algorithms for determining an operating state based on one or more inputs (e.g., property values, sensor signals, metrics, messages/warning, flag values), a functional mapping (e.g., in any suitable dimension of variables), any other suitable information or relationship, or any combination thereof. For example, a reference database may include temperature limits, current limits, time limits, flow rate thresholds, current-temperature mappings, current-time mappings, time-temperature mappings, current-time-temperature mappings, fuse specifics (e.g., type of fuse, slow or fast blow characteristics, cycle life, usage history), any other suitable information, or any combination thereof.

In an illustrative example, the system may determine, at step 408, that the fuse is operating normally or otherwise within an acceptable operating range based on the one or more sensor signals of step 402, and accordingly identify state 410, as illustrated. Normal operation may include control of power electronics to allow current to flow through the fuse (e.g., via a busbar, and any other circuitry), monitoring or maintaining a fluid condition of the fuse (e.g., a temperature, a flow, heat transfer rate), any other suitable functions, or any combination thereof. In some embodiments, normal operation may include the system actively controlling operation of the fuse (e.g., state 414). For example, the system may adjust a flow rate, provide feedback control on a temperature (e.g., a temperature of the fuse or of the fluid), monitor one or more sensor signals, generate one or more control signals, or any combination thereof.

In an illustrative example, the system may determine, at step 408, that a fault has occurred based on the one or more sensor signals of step 402, and accordingly identify state 412, as illustrated. A fault may include an electrical short, a fluid leak of a fuse, an over-temperature of a fuse, a reduced or altered capacity of a fuse, any other suitable condition, or any combination thereof. In response to a fault condition, the system may cease current flow through the fuse, reduce the current flow, alter a fluid flow rate, generate a warning message, shut down the electricals system, disconnect the power source (e.g., a battery system), any other suitable function, or any combination thereof. In some embodiments, a fuse may undergo an irreversible process (e.g., due to overheating). For example, if a fuse is subjected to large currents and associated heating, the current capacity or failure schedule may be altered such that the behavior of the fuse after the irreversible process is not the same as the behavior before the process (e.g., analogous to plastic deformation in solids or other irreversible phenomena).

In an illustrative example, the system may, at step 416, generate a flag, warning, or other indicator based on the one or more sensor signals of step 402. The flag may include, for example, a value stored in memory indicative of the operating state or fault condition. In some embodiments, the system may generate messages, warnings, or other indicators and transmit the indicators to one or more other systems (e.g., a shutdown system, a watchdog, a user interface, a central controller). The indicators may include analog signals, digital signals (e.g., binary values), messages (e.g., using and suitable communications protocol), graphic indicators generated on a display screen, any other suitable type of indicator, or any combination thereof.

Figure 5:
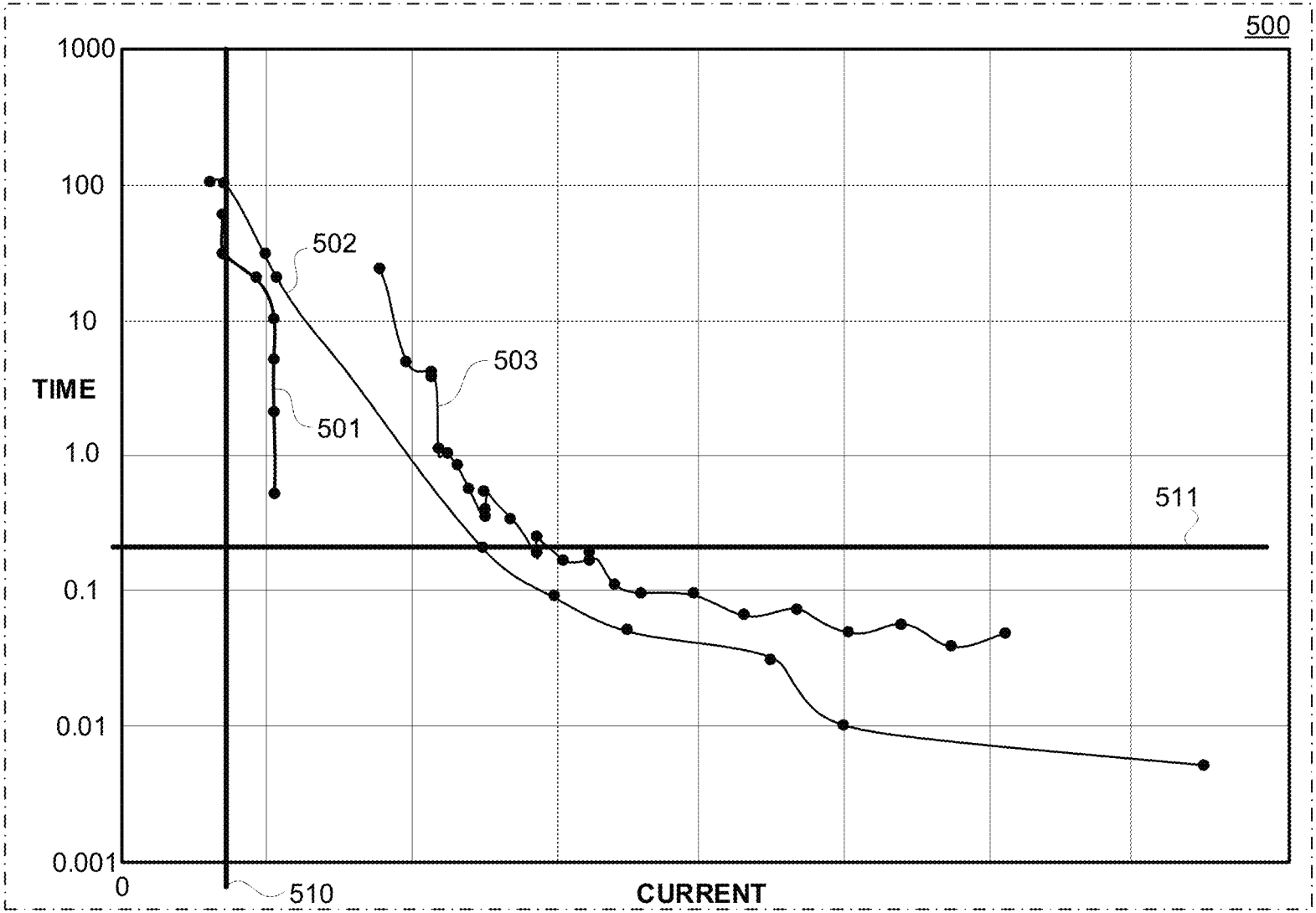
FIG. 5 shows an illustrative plot of fuse blow-time as a function of current for fuses, in accordance with some embodiments of the present disclosure.

FIG. 5 shows illustrative plot 500 of fuse blow-time as a function of current for fuses, in accordance with some embodiments of the present disclosure. The abscissa of plot 500 corresponds to current (e.g., in amps or any other suitable unite), and the ordinate of plot 500 corresponds to time (in seconds). Trace 501 corresponds to one or more loads (e.g., governed by operating ranges of powertrain components, inverters, auxiliary systems, or a combination thereof), trace 502 corresponds to an illustrative fluid-affected fuse, and trace 503 corresponds to the total capacity of other protective components (e.g., fuses of current collectors of a battery system, contactors). In some embodiments, a fuse is designed to operate in a window arranged between traces 501 and 503. For example, a fuse may exhibit a time-current behavior that changes in time due to cyclic use (e.g., from irreversible processes or degradation), and thus is expected to operate within some region of plot 500. That region may be selected and/or designed to fall between traces 501 and 503 to ensure that loads are capable of operating uninterrupted and other protective components do not prematurely fail (e.g., battery cell fuses) or are otherwise not activated (e.g., contactors, which may experience some damage from repeated overcurrent).

Regarding trace 503, fusing may be arranged between each battery cell and current collectors that electrically couple subsets of battery cells together in parallel and in series with other subsets of battery cells. To illustrate, the fusing between battery cells and current collectors may include individual fusible links (e.g., thin wires, necked metal tabs) that are configured to uncouple each battery cell individually in the event of an overcurrent of a cell or a local event (e.g., thermal event, electrical shorting of one or more cells). In a further example, there may be several traces that correspond to protective components. In some embodiments, the failure characteristics of a fluid-affected fuse include failing before the fuses of the current collectors/cells at a given bus current, allowing powertrain currents to reach maximum values without the fluid-affected fuse prematurely failing, or a combination thereof. For example, normal operation may include controlling currents flowing in powertrain components. The powertrain components may have large operating lifespan at lower currents (e.g., below current indicated by line 510), and a reduced operating lifespan at greater currents (e.g., with the operating lifespan decreasing as current increases). For example, powertrain components may operate at relatively short time durations at large or "peak" currents, and may operate continuously at lower currents (e.g., an effectively infinite lifespan or otherwise much larger than timescales indicated on plot 500). To illustrate, a fluid-affected fuse may be configured to allow the powertrain components to achieve larger currents without the fluid-affected fuse prematurely failing.

Further, because the fluid-affected fuse may be arranged in series with a busbar and thus there may be relatively few fluid-affected fuses compared to the large number of fusible links of the current collectors (e.g., corresponding to trace 503), the failure of the fluid-affected fuse may be more easily corrected. To illustrate, replacement of the fluid-affected fuse of a busbar may be less intensive than replacing a large number of fusible links of a current collector coupled to a plurality of battery cells, and thus the fluid-affected fuse may be designed to fail at a relatively lower current than would likely cause the fusible links to fail.

Line 511 corresponds approximately to a time threshold for which, current flow over larger time scales may be affected by fluid in the fuse. For example, at time scales above line 511 (e.g., longer times), the heat generated in the fuse may be transferred by the fluid to affect the operation of the fuse. In a further example, at time scales below line 511 (e.g., shorter times), the heat generated in the fuse might not be effectively transferred by the fluid and thus the fluid may have relatively less impact on fuse operation. To illustrate, the thermal mass of the fluid at conditions below line 511 may be relatively less important to fuse operation (e.g., heat transfer from the fuse element may be surface-area limited). In some embodiments, the benefits of fluid-affected fuses are exhibited for time scales between 1 and 10 seconds. The fluid-affected fuses of the present disclosure may benefit from the added thermal mass of the fluid to mitigate changes in temperature (e.g., which may improve durability), while still allowing for fast response to large current events occurring over short times. Because the time scale of heat transfer may be much longer than the blow-time of the fuse in some circumstances (e.g., at high currents), the presence of the fluid does not significantly impede the ability of the fuse to respond to these events.

The foregoing is merely illustrative of the principles of this disclosure, and various modifications may be made by those skilled in the art without departing from the scope of this disclosure. The above-described embodiments are presented for purposes of illustration and not of limitation. The present disclosure also can take many forms other than those explicitly described herein. Accordingly, it is emphasized that this disclosure is not limited to the explicitly disclosed methods, systems, and apparatuses, but is intended to include variations to and modifications thereof, which are within the spirit of the following claims.

What is claimed is:

1. An apparatus comprising:

a structural housing comprising an internal volume;

a pair of electric terminals coupled to the structural housing and configured to be coupled to an electric power system;

a fuse element electrically connected in series to the pair of electric terminals and arranged at least partially in the internal volume;

a fluid arranged within the internal volume and configured to affect a temperature of the fuse element; and a sensor arranged in a port of the structural housing.

2. The apparatus of claim 1, wherein the port is arranged in the structural housing to be in fluid communication with the internal volume.

3. The apparatus of claim 1, wherein the port is configured to provide the fluid to the internal volume, the apparatus further comprising:

an additional port arranged in the structural housing and configured to remove the fluid from the internal volume.

4. The apparatus of claim 1, wherein the sensor is configured to detect at least one characteristic of the fluid.

5. The apparatus of claim 1, wherein the at least one characteristic comprises a temperature of the apparatus, and wherein the sensor is configured to sense the temperature.

6. The apparatus of claim 1, wherein the at least one characteristic comprises at least one of a temperature of the fluid, a pressure of the fluid, or a composition of the fluid.

7. The apparatus of claim 1, wherein the fluid comprises at least one of water, oil, ethylene glycol, or a combination thereof.

8. The apparatus of claim 1, wherein the fluid is substantially electrically insulative.

9. A system comprising:

an electric power system comprising at least one busbar;

a fuse configured to provide circuit protection, the fuse comprising:

a pair of terminals electrically coupled to the at least one busbar, a structural housing comprising an internal volume, a fuse element electrically coupled between the pair of terminals and arranged in the internal volume, wherein the fuse element is configured to uncouple the terminals at a predetermined condition, and a fluid arranged in the internal volume and configured to affect a temperature of the fuse element;

a sensor arranged in a port of the structural housing, wherein:

the port is configured to provide the fluid from the internal volume; and control circuitry configured to monitor at least one characteristic of the fuse during operation.

10. The system of claim 9, wherein the sensor is configured to sense at least one characteristic of the fluid, wherein the sensor is communicatively coupled to the control circuitry.

11. The system of claim 10, wherein the at least one characteristic comprises a temperature of the fluid arranged in the internal volume.

12. The system of claim 9, further comprising a fluid management system configured to circulate a fluid stream through the internal volume of the structural housing, wherein the fluid in the internal volume is supplied by the fluid stream.

13. The system of claim 12, wherein the port is a first port, wherein the fuse further comprises a second port arranged in the structural housing, and wherein the fluid stream enters the internal volume via the first port and leaves the internal volume via the second port.

14. The system of claim 12, wherein fluid management system comprises a pump, fluid conduits, and fittings configured to manage the fluid stream.

15. The system of claim 12, wherein the control circuitry is coupled to the fluid management system, and wherein the control circuitry is further configured to provide a control signal to the fluid management system to control the fluid stream.

16. The system of claim 15, wherein the control circuitry is further configured to provide the control signal to the fluid management system to control a temperature of the fuse.

17. A method for managing a fluid-affected fuse, the method comprises:

monitoring one or more sensor signals generated by a sensor element arranged in a port of a structural housing of the fluid-affected fuse, wherein the one or more sensor signals is indicative of fuse operation;

applying current to one or more busbars of a battery system, wherein a fuse element is arranged within an internal volume of the structural housing and is electrically coupled to the one or more busbars; and generating a control signal for controlling a fluid stream configured to flow through the internal volume to affect a temperature of the pair of fuse elements based on the one or more sensor signals.

18. The method of claim 17, wherein monitoring the one or more sensor signals comprises monitoring a temperature sensor signal of the sensor, wherein the sensor comprises a temperature sensor configured to sense a temperature of the fluid stream, and wherein generating the control signal comprises generating the control signal to control a temperature of the fuse element.

19. The method of claim 17, further comprising determining a fault has occurred based on the one or more sensor signals.

20. The apparatus of claim 1, wherein the port is configured to remove the fluid from the internal volume, the apparatus further comprising:

an additional port arranged in the structural housing and configured to provide the fluid to the internal volume.

* * * * *